United States Patent [19]

Motev et al.

[11] Patent Number: 4,578,880

[45] Date of Patent: Apr. 1, 1986

[54] CURING APPARATUS WITH EJECTOR MECHANISM

[75] Inventors: Phil Motev, Lincolnwood; Melvin E. Green, Evanston, both of Ill.

[73] Assignee: American Screen Printing Equipment Company, Chicago, Ill.

[21] Appl. No.: 663,961

[22] Filed: Oct. 26, 1984

[51] Int. Cl.[4] ..... F26B 11/00

[52] U.S. Cl. ..... 34/105; 34/4; 34/39; 34/236; 34/239; 118/642

[58] Field of Search ..... 34/4, 39, 104, 105, 34/236, 239; 118/641, 642, 643; 198/478, 480, 483, 484, 803

[56] References Cited

U.S. PATENT DOCUMENTS

| | | | |
|---|---|---|---|
| 554,973 | 2/1896 | Bates | 34/105 |
| 1,671,321 | 5/1928 | Smith | 198/484 |
| 2,355,459 | 8/1944 | Miskella | 34/236 |
| 2,445,451 | 7/1948 | Padelford | 118/642 |
| 3,045,358 | 7/1962 | Breakell et al. | 34/105 |
| 3,840,999 | 10/1974 | Whelan | 34/105 |
| 4,066,866 | 1/1978 | Fresnel | 34/216 |
| 4,535,549 | 8/1985 | Lala et al. | 34/4 |

*Primary Examiner*—Larry I. Schwartz
*Assistant Examiner*—David W. Westphal
*Attorney, Agent, or Firm*—Fitch, Even, Tabin & Flannery

[57] ABSTRACT

An apparatus for curing ink screen print on articles, particularly large articles such as pails or barrels, includes a rotatable turntable having a plurality of spin table compartments each of which is to receive a pail and carry the same in a circular path past a radiation source covered by a housing at a curing station. Each article is spun as it reaches the curing station to assure complete irradiation about the circumference of each article. The housing is provided with a large opening to facilitate loading of articles onto the spin tables and removal of articles with cured ink from the spin tables. An ejector mechanism is mounted on the apparatus to automatically eject cured articles from the turntable to reduce the labor needed to operate the apparatus. The preferred ejecter mechanism includes a fluid cylinder having a pusher mounted centrally of the turntable, and operable to extend into a compartment to push an article therefrom onto a takeaway conveyor. Operation of the ejector mechanism disables the turntable drive mechanism.

8 Claims, 9 Drawing Figures

FIG. 6
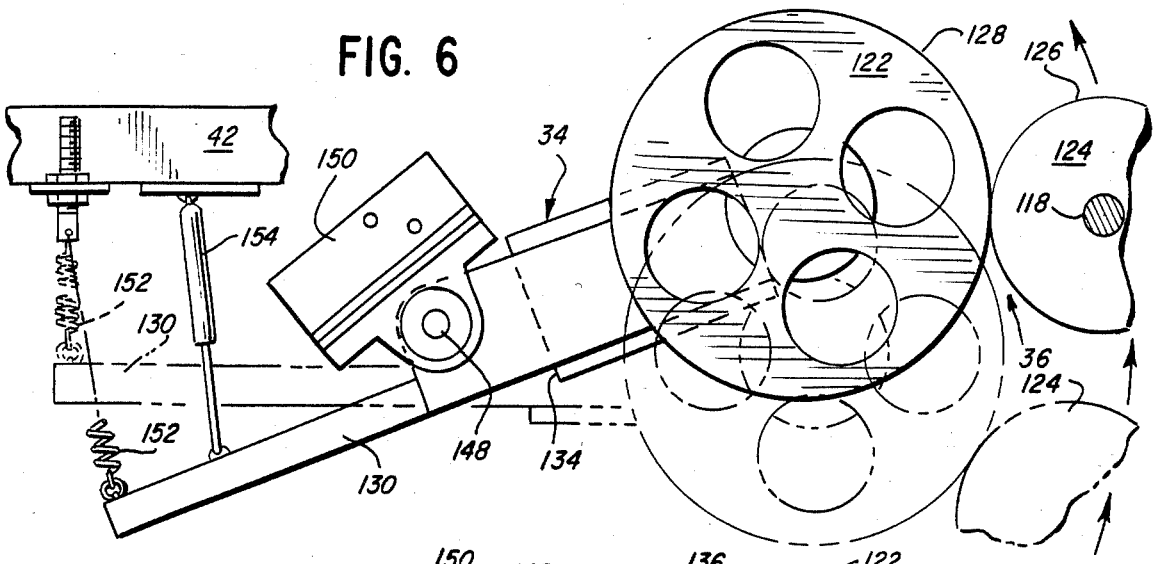
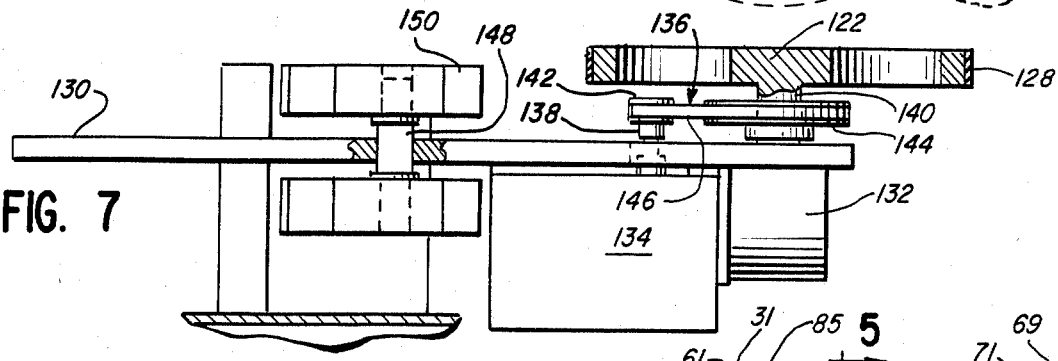
FIG. 7
FIG. 8
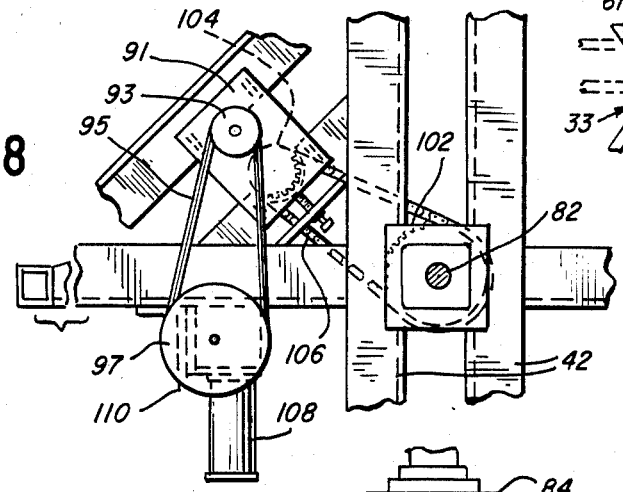
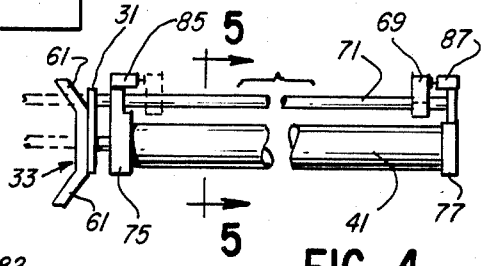
FIG. 4
FIG. 9
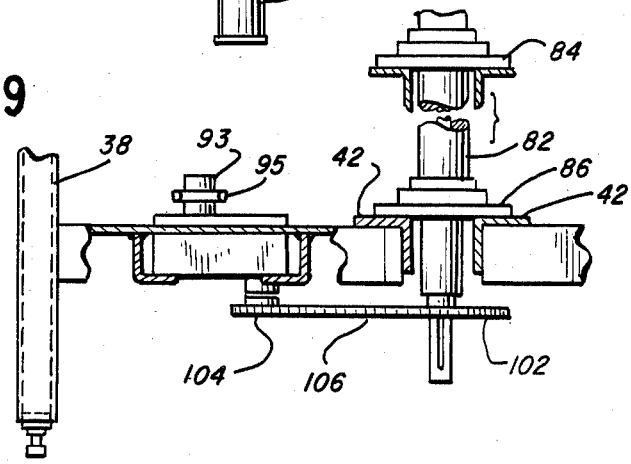
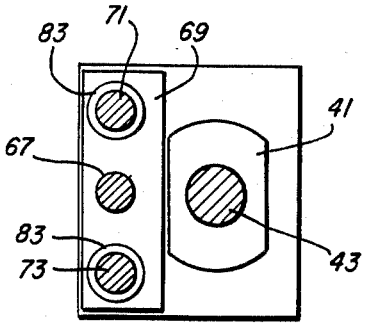
FIG. 5

CURING APPARATUS WITH EJECTOR MECHANISM

BACKGROUND OF THE INVENTION

The present invention relates generally to ink curing apparatus and methods of handling large articles, such as 5-gallon pails to 55-gallon drums.

Various articles have labels or designs printed upon their exterior surfaces with ink which may be cured by exposure to infrared or ultraviolet radiation. Typical of such articles are large plastic containers, such as 5-gallon pails or buckets and other containers including 55-gallon drums. Because the printed matter on such articles frequently extends around the entire circumference of the article or is located at various locations about the circumference of the article, it is desirable that curing apparatus provide 360° exposure to ultraviolet radiation for each article. In the past, some types of curing apparatus have included means for gripping container necks to support them and rotate them while transporting them past an ultraviolet lamp. While such apparatus may be satisfactory for use with necked containers, it may not be suitable for curing ink on large articles such as buckets which do not have necks.

Large articles such as five-gallon paint buckets or even larger barrels are difficult to handle. Most existing equipment is not, or can not be, adapted to cure such articles in an economical manner. U.S. patent application Ser. No. 548,207 filed Nov. 2, 1983 and assigned to the assignee of this application discloses an inexpensive and efficient apparatus to cure ink on such large articles.

In the handling of such articles, the exposure of persons to excessive amounts of ultraviolet radiation is undesirable. Thus, ultraviolet curing apparatus has an ultraviolet lamp enclosed within a housing for confining the radiation, and a turntable for transporting the articles past the lamp within the housing. The turntable may have a series of compartments each of which receives an article and is separated by compartment walls which allow loading or unloading of the articles without exposing any workers to the radiation.

In commercial printing operations, ultraviolet curing apparatus is commonly used in proximity to the printing equipment which deposits the ink on the articles so that the ink may be cured immediately after it is applied. It is desirable that the curing apparatus be capable of being loaded and unloaded with minimal labor as labor expenses add significantly to the cost of the printed article. Because the exposure time required to cure the ink on a particular article may be relatively short, it is most desirable to reduce the period of time required for loading an article and for transporting the article from an input location to the curing station and then to an output location for unloading the article with cured ink thereon. Often two persons are used with one person doing the loading and another person doing the unloading. There is a continuing demand for improvements in the handling of articles to increase the efficiency of curing operations and to reduce the labor costs associated therewith.

SUMMARY OF THE INVENTION

In accordance with the present invention, curing apparatus is provided which includes means to automatically eject the irradiate articles. Preferably, a single opening in the housing allows a single worker at a single location to load articles onto the turntable for curing and the cured articles are automatically discharged from the turntable at a discharge station. To prevent emission of light from the ultraviolet lamp to the exterior of the housing through the opening, an upstanding divider is mounted on the turntable. The divider defines a plurality of compartments on the turntable for containing the articles, and the articles are spun within their respective compartments while being irradiated. The present invention provides a low cost ejector mechanism for automatically ejecting the articles having cured ink thereon from the curing apparatus at a discharge station. Preferably, the discharged article is conveyed away automatically by a conveyor.

Accordingly, a general object of the invention is to provide a new and improved apparatus for irradiating ink on articles.

These and other objects and advantages of the invention will become apparent from the following detailed description taken in connection with the accompanying drawings in which:

BRIEF DESCRIPTION OF THE DRAWINGS

FIG. 4 is fragmentary plan view of the ejector mechanism used to eject articles from the curing apparatus.

FIG. 5 is an enlarged cross-sectional view taken substantially along the line 5—5 in FIG. 4.

FIG. 6 is an enlarged fragmentary plan view of the spin table drive of the curing apparatus of FIG. 1.

FIG. 7 is a side elevational view of the spin table drive illustrated in FIG. 6, shown with portions broken away.

FIG. 8 is a plan view of the turntable drive of the curing apparatus in FIG. 1.

FIG. 9 is a side elevational view of the turntable drive of FIG. 8.

DETAILED DESCRIPTION OF A PREFERRED EMBODIMENT

Figure 1:
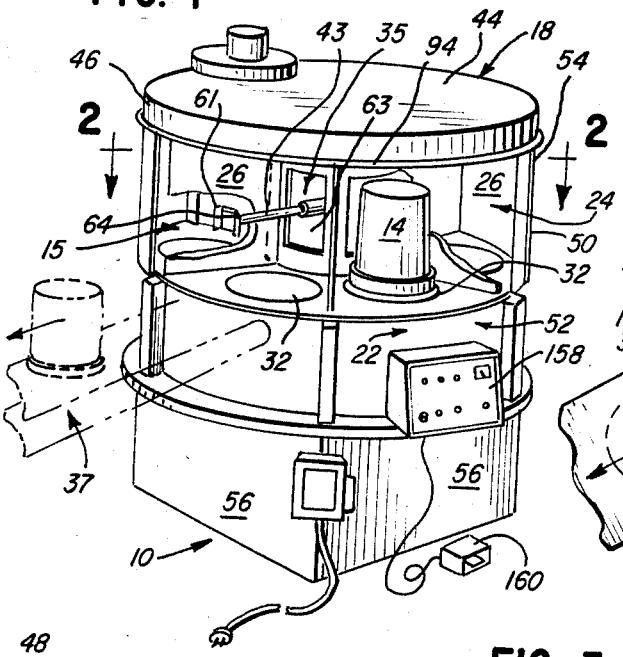
FIG. 1 is a perspective view of curing apparatus in accordance with the present invention, shown with portions broken away for clarity.

The present invention is generally embodied in a method and apparatus, indicated generally at 10, for curing ink 12 (FIG. 3) on exterior surfaces of articles 14 by irradiating the exterior surfaces of the articles 14 and for automatically discharging the cured ink article from the apparatus. The apparatus 10 includes irradiating means for irradiating ink on the articles. Although the irradiating means could provide infrared or other radiation, the preferred irradiating means comprises one or more ultraviolet lamps 16 for providing ultraviolet light at a curing station within a housing 18. The housing 18 is supported by a frame 20 to shield against workers viewing the UV light as articles are loaded and unloaded onto a turntable 22.

The turntable 22 is mounted for rotation within the housing 18 and which supports the articles 14 from below. A worker at a loading station 17 loads articles 14 onto the turntable 22 through an opening 24 in the housing 18. To prevent emission of light from the ultraviolet lamp 16 to the exterior of the housing 18 through the opening 24, an upstanding divider means 26 is mounted on the turntable 22 and divides the turntable into a plurality of sector-shaped, article-receiving compartments, each of which receives an article 14 and carries the article in a counterclockwise direction into and past the curing station. Herein, six compartments, each having a spin table 32 to rotate the article therein are provided on the turntable. Three compartments are available at the opening for loading and unloading.

Figure 2:
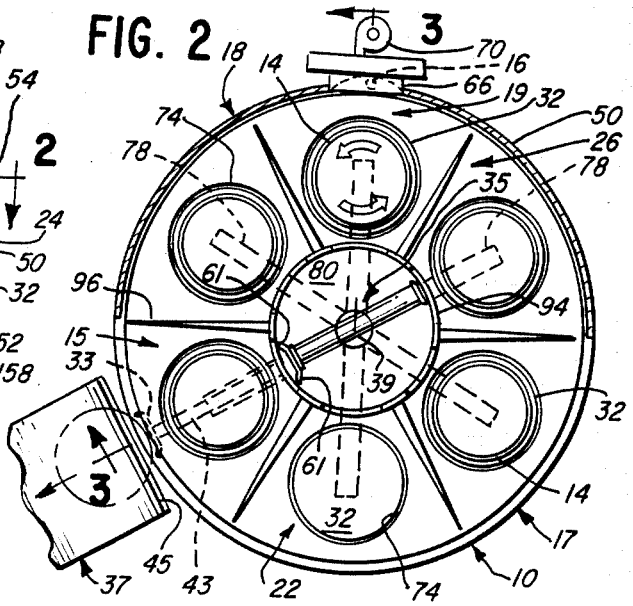
FIG. 2 is a sectional view of the apparatus of FIG. 1, taken along line 2—2 and looking in the direction of the arrows.

Herein, the articles 14 are transported by a turntable 22 mounted for turning about a vertical axis from a loading station, in a counterclockwise direction as viewed in FIGS. 1 and 2, to a curing station at which the UV lamp 16 cures the ink on the articles. At the curing station 19, the articles are rotated by spin table 32 through greater than 360° to assure that the entire peripheral surface of the article is exposed to the UV light. After the UV curing the articles are transported by the turntable to the discharge station 15 for discharge from the turntable.

The illustrated articles 14 are five-gallon pails and the usual practice is for one person to be located at the loading station 17 to place the articles onto a spin table 32 while another person located at the discharge station 15 removed the articles from a spin table 32. With the high cost of labor, it is desired to be able to eliminate a worker at the discharge station. A problem with providing an ejector means at the discharge station is that the turntable 22 supports the articles from below and that the housing 18 must cover the articles as they go to the curing station and exit from the curing station. Thus, the housing 18 and turntable 22 interfere with the situating of an ejector means within the curing apparatus disclosed in the aforementioned patent application.

In accordance with the present invention, the cured articles 14 are automatically discharged at the discharge station 15 from a turntable 32 by an ejector means 35 which ejects the pail, preferably onto a conveyor which carries the article 14 away from the apparatus 10. The ejector means 35 and conveyor 37 eliminate the expense of the manual labor of one person who would unload the article while another person would load the articles onto a spin table at the loading station 17. The mounting of the ejector means is preferably achieved by suspending the same from the central top wall or roof 44 of the housing 18 at a turning axis 39 of the turntable 22 so that the ejector means does not interfer with the shielding by the housing 18 or the movement of the turntable therebelow.

An inexpensive and simple ejector means 35 may be provided by use of a fluid actuated cylinder 41 having a reciprocable rod or pusher 43 with a forked end 33 that engages the cured article along the inner circumference thereof about mid-height of the article. As best seen in FIG. 2, the pusher will extend from its retracted position, shown in full lines in FIG. 2, to its extended position, shown in dotted lines in FIG. 2, in which its forked end is adjacent an end 45 of the conveyor 37. As will be explained in greater detail hereinafter, it is preferred that the turntable be stationary and that its drive be disabled during the article discharge operation.

Turning now to a more detailed description of the ejector means 35, in its preferred form, includes a suspension means 37 for suspending the cylinder 41 from the roof 44 of the housing. More specifically, the housing roof 44 includes a horizontally extending, frame beam 49 (FIG. 3) which supports a sheet metal circular panel 51 of the roof 44. A stationary, vertical shaft 53 is fixed at its upper end to beam 49 and is centered on the axis 39 of the turntable 22. A cylinder mounting block 55 is secured to the lower end of the shaft 53 and has a horizontally extending bore 57 through which extends the cylinder 41. To center and stabilize the mounting block 55 and cylinder 41, the lower end of the block receives the upper rotating end 57 of a rotating central hub 80 of the turntable 22. The hub end 57 is cylindrical and is mounted for turning in a bearing 59 which is secured in the mounting block 55 and centered on the rotational axis 39 for the hub 80 and turntable 22. Thus, the suspension means 47 is stabilized at both its upper and lower ends to assist in maintaining the pusher 43 in its travel along a horizontal path and to hold the pusher while in its fully extended state as shown in FIG. 2.

Herein, the illustrated cylinder 42 is a hydraulic cylinder with its piston rod serving as the pusher 43. The forked end 33 of the pusher comprises a pair of vertical plates 61 angled from a central plate to form a V-shape to center a portion of the cylindrical sidewall of the article 14 therebetween.

Each of the compartments of the turntable is provided with an interior window or opening 63 in an otherwise cylindrical wall 94 which defines the interior wall of each compartment. The window 63 is of sufficient size to allow the forked end 33 to pass therethrough to engage the article on a spin table 32. As will be explained in greater detail, radially extending compartment walls 96 project radially outwardly from the central cylindrical wall 94 to define the six compartments each of which is indexed to bring its window 63 in its rear compartment wall into alignment with the pusher when it arrives at the discharge station 15.

To assist in assurance of the rectinlinear movement of the hydraulic cylinder rod pusher, there is provided guide means which comprises a sliding guide rod 67, as best seen in FIGS. 4 and 5, and a sliding guide block 69 both of which travel with the pusher rod. The guide means also includes a pair of stationary parallel shaft 71 and 73 fixed at opposite ends to stationary plates 75 and 77 which are in turn fixedly secured to opposite ends of the cylinder 41. The parallel shafts 71 and 73 are mounted parallel to the axis of the cylinder and to the pusher rod and are mounted in a vertical plane with the sliding guide rod 67 therebetween, as shown in FIG. 5.

The guide rod 67 slides through a bore in the front plate 75 attached to the front end of the cylinder 41. The rear end of the guide rod is attached to the slideable guide 69 which has slide bearings 83 encircling the stationary shafts 71 and 73. As the guide block is pushed and pulled by the slide rod 67, the bearings 83 slide along the stationary rods 71 and 73 and stabilize and guide the slide rod 67 which is attached at its front end by a bracket 31 to the pusher fork 33. Thus, the spaced parallel pusher rod 43 and the guide 67 will hold the pusher's forked end against turning and aid in preventing and binding of the pusher rod when it is experiencing turning torques from resistance of the article to sliding from the turntable onto the conveyor 37.

In accordance with the preferred embodiment of the invention, the operation of the ejector means 35 disables the turntable drive 28 so that the turntable remains stationary while the pusher rod is moving through the window 63 in the rear compartment wall 94. This avoids jamming of the compartment wall 94 against an extended pusher rod 43 as could occur if the turntable rotated while the pusher rod was extended. The turntable drive is disabled by a disabling means which comprises limit switch means operable by movement of the pusher rod from one of its limit portions. Also, to control reversal of the cylinder to retract the pusher rod 43, there is provided a forward, extended limit switch 85 which is secured to the forward stationary plate 75 to be engaged and actuated by the guide block 69 when the latter is in its forward position adjacent the plate 75, as shown in dotted lines in FIG. 4. A rear limit switch 87 is fastened to the rear plate 77, which is fixed to the rear end of the cylinder, and this rear limit switch is actuated when the pusher has fully retracted and the guide block 69 is actuating the rear limit switch. Actuation of the limit switch by the guide block 69 enables the turntable drive means 28 to index the turntable to bring the next compartment into the discharge station. When the block 69 travels from the microswitch 87, it changes state and disables the turntable drive means 28. When the guide block 59 engages the microswitch 85, it causes a reversal of movement of the hydraulic cylinder pusher rod 43.

At the curing station, each article 14 is rotated by a spin table 32 for 360° exposure as it is carried past the ultraviolet lamp 16. One spin table 32 is rotatably mounted on the turntable 22 in each compartment. Spin table drive means 34, as best seen in FIGS. 6 and 7, are provided for rotating the spin tables 32 relative to the turntable 22. In the illustrated embodiment, the spin tables 32 are not connected to the spin table drive means 34 when they are in position adjacent the opening 24 in the housing 18, so that articles 14 may be loaded onto or unloaded from the turntable 22 without the spin tables 32 rotating. A clutch assembly 36 (FIGS. 6 and 7) is provided to selectively associate the spin table drive means 34 with each of the spin tables 32 as the particular spin table 32 approaches the ultraviolet lamp 16.

The illustrated apparatus 10 is sized to handle articles 14 such as buckets on the order of twelve inches or more in height. In another embodiment of the invention not illustrated herein, the apparatus is sized to accommodate much larger articles, such as 55 gallon drums.

Figure 3:
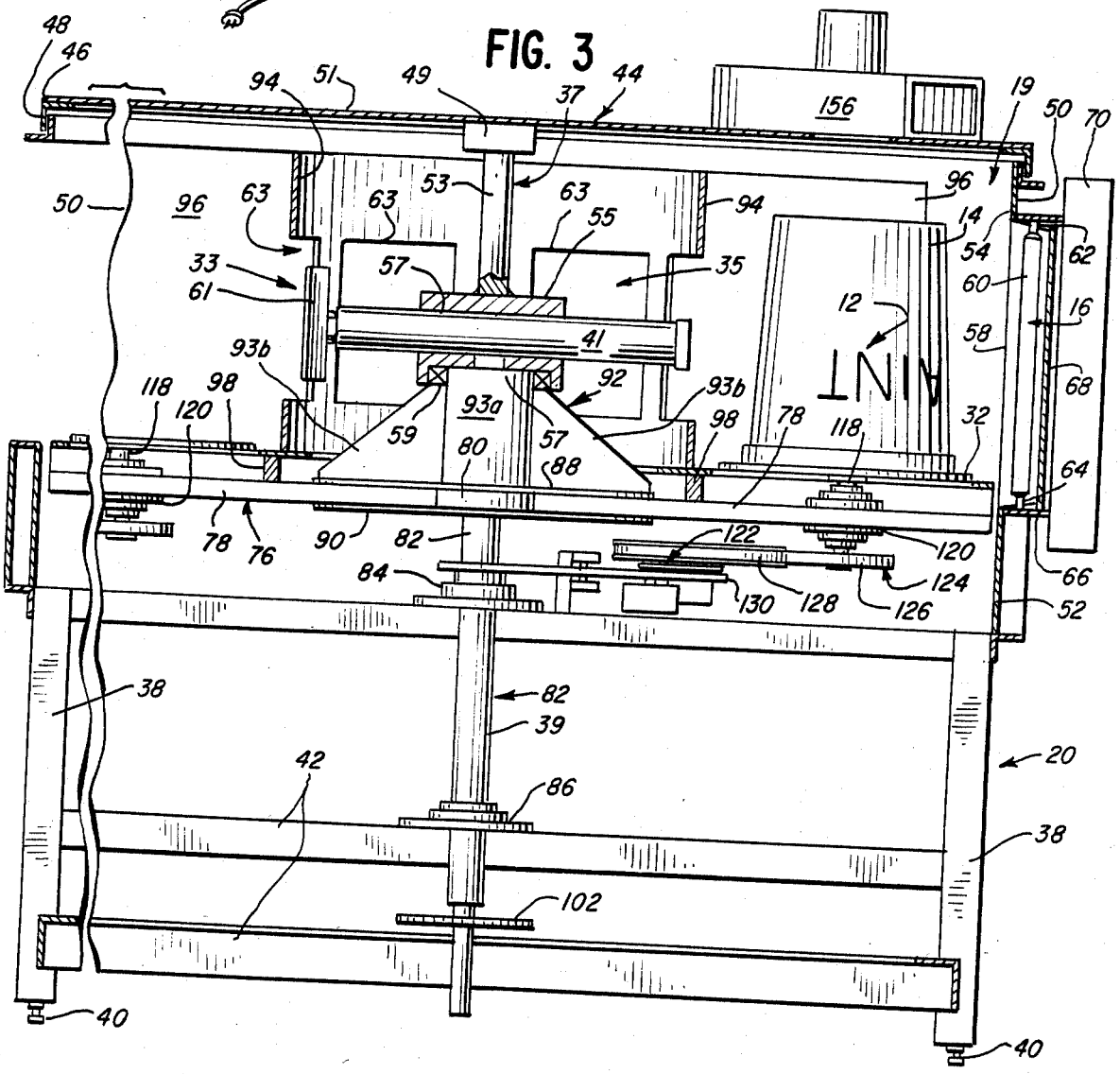
FIG. 3 is an enlarged sectional view of the apparatus of FIG. 1, taken along line 3—3 in FIG. 2 and looking in the direction of the arrows.

Turning now to a more detailed description of the illustrated embodiment of the present invention the frame 20, as best seen in FIG. 3, includes a plurality of upstanding legs 38 having adjustable feet 40 at their lower ends for leveling the apparatus 10. A plurality of horizontal support members 42 extend between the legs 38 for supporting various components of the apparatus 10, as described in greater detail below.

The housing 18 is supported by the frame 20 and includes the top wall roof 44 having a generally circular periphery 46 with a depending skirt 48. The top wall 44 is supported by a curved side wall 50 which has a lower portion 52 which extends about the circumference of the turntable 22 below the turntable, and an upper portion 54 which extends partially around the circumference of the turntable 22 above the turntable, thus defining the opening 24 which provides access to the turntable 22. In the illustrated embodiment, the opening 24 extends approximately halfway around the circumference of the side wall 50. The relatively long circumferential dimension facilitates insertion and removal of articles through the opening 24 by providing access to each spin table 32 during approximately half of its travel. A plurality of side panels 56 (FIG. 1) enclose the frame 20 beneath the turntable 22.

To provide ultraviolet radiation within the housing 18, the ultraviolet lamp 16 is mounted on the curved side wall 50 adjacent an opening 58 in the side wall 50. The lamp 16 herein includes an elongated bulb 60 having an effective length equal to or greater than the height of the printed area being irradiated which, in this instance, is about twelve inches. The bulb 60 is oriented vertically and supported at its upper and lower ends 62 and 64 respectively in a holder 66 which is mounted on the stationary housing 18 adjacent the opening 24. A reflector 68 is provided to direct radiation from the bulb 60 through the opening 58 to the interior of the housing 18. To prevent the bulb 60 from overheating during use, a blower 70 (FIG. 2) supported by the holder 66 maintains air flow about the bulb 60. The holder 66 is preferably mounted on hinges (not shown) to pivot to an open position to expose the curing station and facilitate changing of the bulb 60.

While a single, vertically-oriented bulb 60 is employed in the illustrated embodiment, other embodiments of the invention may include more than one bulb, or have a single bulb oriented horizontally. For example, two vertically oriented bulbs positioned end to end may be used for curing articles having greater height than the illustrated buckets, and a single horizontal bulb may be used for shorter articles. Also, two vertical bulbs positioned side by side may be preferable for articles of certain configurations.

The turntable 22 herein includes a generally circular plate 72 having a plurality of generally circular openings 74 formed in it at predetermined locations to accommodate the spin tables 32. The turntable 22 further includes a spider 76 which comprises a number of radially extending members 78 joined at a central hub 80 for supporting the spin tables 32 and the circular plate. The hub 80 is fixed to a rotatable shaft 82. The shaft 82 extends generally vertically downward from the center of the turntable 22 and is supported by upper and lower thrust bearings 84, 86 respectively mounted on horizontal support members 42.

The hub 80 herein includes upper and lower, horizontal extending plates 88 and 90 respectively disposed respectively above and below the radial members 78 and a stiffener means 92 which is fixed to the upper plate 88. The stiffener means 92 includes a generally cylindrical central member **93*a* and a plurality of generally triangular gusset plates 93*b* extending radially outward therefrom and welded thereto along their vertical edges and welded to the upper plate 88** along their lower horizontal edges.

As noted above, emission of ultraviolet radiation from the interior of the housing 18 is prevented by the upstanding divider means 26 which also divides the turntable into compartments. The divider means 26 herein includes the central, generally circular cylindrical wall 94 and the planar compartment walls 96 extending radially outward from the central wall 94. Both the central wall 94 and the compartment walls 96 are supported by the generally circular plate 72. The plate 72 is supported by an annular support 98 (FIG. 2) mounted on the spider 76.

In the illustrated embodiment, six spin tables 32 are evenly spaced about the turntable 22 and each spin table 32 is separated from the adjacent spin tables 32 on each side by one of the compartment walls 96. Each pair of adjacent compartment walls 96 thus defines an included angle of about 60°. This configuration provides that at least one radial compartment wall 96 is positioned between the lamp 16 and the opening 24 at all times during operation of the apparatus 10, while also providing adequate space for six relatively large articles 14 such as buckets to be carried simultaneously by the turntable 22.

Referring particularly to FIGS. 8 and 9, the preferred turntable drive means 28 for indexing the turntable for intermittent movement includes a driven sprocket 102 fixedly mounted on the turntable shaft 82, and a drive sprocket 104 connected to the driven sprocket 102 by a drive chain 106 looped around the two sprockets 102 and 104. The sprocket 104 is secured to the output shaft of a commercially available indexing device 91 which is a modified Geneva mechanism to give a one-sixth turn of the sprocket 104 when the indexing device 91 is operated. The illustrated indexing device is a commercially available device sold by E. W. Lancaster Company, of Chicago, Il. The indexing device 91 is driven by an input pulley or sprocket 93 driven by an endless chain or belt 95 which in turn is driven by a sprocket or pulley 97 which is attached to an output shaft of a speed reducing gear box 110 driven by an electric motor 108. Thus, the motor drive is able to index the turn table 32 to bring one article from the curing station and to bring another article into the curing station. Thus, a cured ink article 14 is discharged from the discharge station 15 during the stationary dwell time between indexing movements of the turntable to move an article into and from the curing station.

As best seen in FIGS. 2 and 3, each of the spin tables 32 herein is generally circular and is supported by one of the radial members 78 of the spider 76. Each spin table 32 is mounted on a shaft 118 extending vertically downward from its center, and each of the shafts 118 is supported in a thrust bearing 120 mounted on the associated support member 78.

As noted above, spin table drive means 34 and an associated clutch assembly 36 are provided to rotate each spin table 32 as it passes the ultraviolet lamp 16. The clutch assembly 36 herein includes a continuously rotating drive wheel 122 for cooperation individually with a plurality of driven wheels 124, one mounted on each of the spin table shafts 118. Each driven wheel 124 is adapted to be rotated by engagement between its peripheral surface 126 and the peripheral surface 128 of the drive wheel 122.

Suitable material is disposed on the respective peripheral surfaces 126 and 128 to provide adequate frictional engagement therebetween. The drive wheel 122 is mounted on a clutch lever 130 which is pivotally supported on one of the frame members 42.

The power for the spin table drive 34 herein is provided by a variable speed electric motor 132 (FIG. 7) acting through an associated gearbox 134, both of which are mounted on the clutch lever 130. To avoid damaging the gearbox 134 with shock loads as the drive wheel 122 comes to engagement with a driven wheel 124, a belt drive 136 (FIG. 7) connects the output shaft 138 of the gearbox 134 to the drive wheel shaft 140. The belt drive comprises a first pulley 142 mounted on the output shaft 138, a second pulley 144 mounted on the drive wheel shaft 140, and a V-belt 146 interconnecting the pulleys.

Referring particularly to FIG. 4, the clutch lever 130 and drive wheel 122 herein are positioned as illustrated in broken lines prior to engagement with one of the driven wheels 124. As the turntable 22 rotates, one of the driven wheels 124 comes into engagement with the drive wheel 122. The drive wheel 122 rotates continuously during operation of the apparatus 10, so that the spin table 32 begins to rotate when the driven wheel 124 moves into engagement with the drive wheel 122.

To enable contact to be maintained between the drive wheel 122 and the particular driven wheel 124 as the spin table 32 travels past the light source 16, the clutch lever 130 pivots about a vertical axle 148 (FIGS. 6 and 7) through a mounting block 150 mounted on the frame member 42. At a predetermined location past the ultraviolet lamp 16, the driven wheel 124 moves out of engagement with the drive wheel 122. The clutch lever 130 is then returned to its initial position by biasing means such as the illustrated coil spring 152 (FIG. 6). To control the speed at which the clutch lever 130 is pivoted by the spring 152, damping means such as the illustrated shock absorber 154 are provided. The shock absorber 154 herein is pivotally connected to the frame member 42 at one end and to the clutch lever 130 at the other end. Once the clutch lever 130 has returned to its initial position, the drive wheel 122 is in position to engage the next driven wheel 124 approaching the ultraviolet lamp 16.

Operation of an ultraviolet lamp in normal atmosphere produces ozone. To prevent ozone from accumulating in the work area around the apparatus 10, exhaust means 156 (FIG. 3) are provided for removing ozone from the interior of the housing 18 at the curing station adjacent the ultraviolet lamp 16. The exhaust means 156 may be connected to a suitable duct (not shown) having an outlet at a location remote from the work area.

If an article 14 is not located approximately centrally upon a spin table 32, rotation of the spin table 32 may cause the article 14 to tip over or slide off of the spin table 32. Accordingly, it is desirable that the operator center article 14 upon its associated spin table 32. Locating devices such as pins (not shown) may be provided on the spin tables to center the article and to hold the same against movement during the spinning and curing.

It will be appreciated that under normal working conditions, it may be desirable for a worker to stop the turntable 22 momentarily to adjust the position of an article 14 upon its spin table 32 or for some other reason. However, stopping the turntable 22 may result in overexposure of an article to the ultraviolet lamp 16 which may cause overheating. It is undesirable to turn the lamp on and off repeatedly because this might reduce bulb life, and because there may be a warm-up time required to bring the bulb to full light-emitting capacity after it is turned off. Accordingly, to enable the turntable 22 to be stopped without overheating an article 14 adjacent the lamp 16, the apparatus 10 includes control means 158 for putting the apparatus 10 into a standby mode wherein the turntable 22 stops rotating, the power to the ultraviolet lamp 16 is reduced, and the spin table 32 adjacent the ultraviolet lamp 16 continues to rotate. In one embodiment, the lamp emits 300 watts per square in. during normal operation, and emits 125 watts per square in. in standby mode. In the illustrated embodiment, the control means 158 is connected to a foot switch 160 for putting the apparatus 10 into standby mode. Depression of the foot switch 160 initiates standby mode, and release of the foot switch 160 returns the apparatus 10 to normal condition. Additional switches and the like are mounted upon a control panel 162 attached to the housing 18.

Turning now to a description of the operation of the present invention, an operator inserts an article 14 through the opening 24 in the housing 18 and placing it upon a spin table 32 as the turntable 22 rotates. It will be appreciated that during normal operation, the articles 14 will be successively placed one by one onto the respective spin tables 32 in the respective compartments, either manually or mechanically.

The turntable 22 preferably is indexed intermittently to transport the articles 14 successively past the ultraviolet lamp 16. However, as noted above, it may be necessary to stop the rotation of the turntable 22 momentarily by switching the apparatus 10 to standby mode for adjustment of the position of an article 14 or for some other reason.

As each spin table 32 approaches the ultraviolet lamp 16, the spin table drive 34, acting through the clutch assembly 36, commences rotation of the spin table 22. It is desirable that each spin table 32 rotate through more than 360° so that each article 14 is exposed to the ultraviolet lamp 16 on all sides as the turntable carries the article in one direction about the turntable axis while the article spins about the axis generally through its vertical centerline.

In addition to irradiating the articles with ultraviolet light, the ultraviolet lamp 16 also heats the articles. Continuous exposure of a particular portion of an article 14 to the ultraviolet radiation may overheat that portion of the article 14 and damage it. To avoid such overheating while providing adequate time of exposure to the ultraviolet radiation, it may be desirable to rotate each article 14 through two or three complete revolutions as it passes the ultraviolet lamp 16. This enables every part of the article 14 to be exposed for two or three separate, relatively short time periods rather than one relatively long time period, enabling cooling to take place between exposures. Also, by providing two or three complete revolutions, a large margin of error is provided to insure that each article 14 actually rotates through at least 360° while it is being transport through a 60° sector of the turntable travel.

To facilitate removal of the articles 14 from their associated spin tables 32, as each spin table 32 reaches a predetermined location beyond the ultraviolet lamp 16, the clutch assembly 36 disengages to permit the rotation of the spin table 32 to slow or stop. As each spin table compartment reaches the discharge station 15, the article 14 is automatically ejected leaving the spin table compartment available for the next article 14 to be placed therein.

Herein, after completing an indexing step, the hydraulic cylinder 41 is actuated to extend its pusher rod 43 to bring the forked end against the inner side of the article. Continued outward movement of the pusher rod slides the bottom of the article across the spin table 32 and across the outer margin of the turntable plate 72 and onto the end 45 of the continuous conveyor 37, which conveys the article away, as shown in FIG. 2. During this travel of the pusher rod, the guide block 69 had moved away from the limit switch 87 to change its state and thus disable the turntable drive. When the block hits the limit switch 85, the cylinder 41 reverses movement of the pusher rod to return guide block 69 to abut the limit switch 87 to enable the turntable drive to index the turntable once more.

From the foregoing, it will be appreciated that the present invention provide a novel and improved apparatus for curing ink on exterior surfaces of articles. While a preferred embodiment has been illustrated and described, there is no intent to limit the scope of the invention to this or any other particular embodiment. The scope of the invention is defined by the spirit and language of the following claims.

What is claimed is:

1. Apparatus for curing ink on exterior surfaces of articles by irradiating the ink, the apparatus comprising:

a frame;

a housing fixed to the frame;

an ultraviolet radiation source fixedly supported by said frame;

a turntable rotatably supported within the housing by the frame;

turntable drive means for rotating the turntable;

a plurality of spin tables rotatably mounted upon the turntable for supporting said articles from below;

at least one opening in said housing through which articles may be placed onto a spin table and through which articles may be discharged from a spin table, compartments on the turntable enclosing each of said spin tables to protect against ultraviolet light emission from UV light source and through said opening in said housing at the curing station;

spin table drive means for rotating said spin tables within their compartment so that articles supported by said spin tables may be irradiated on all sides by the ultraviolet light radiation source.

an ejector means including a pusher mounted centrally within said housing and operable to extend radially outwardly through each of said compartments when aligned with said opening in said housing to push an article from the spin table and from the turntable and through said opening in said housing, said pusher being retractable to allow turntable movement to bring the next article into position for ejection.

2. Apparatus for UV light curing of articles and for automatically ejecting articles therefrom, said apparatus comprising:

a housing defining an enclosure for a curing station, a UV curing means at a UV curing station in said housing, a turntable rotatably mounted in the housing and having compartments thereon with walls to shield the UV light, an opening in said housing defining a discharge station for said articles, said compartments shielding against UV light emission through said opening, an ejector means mounted centrally within said housing and radially inward of said turntable and radially inward of said compartments, each of said compartments having an interiorly facing opening therein, said ejector means including a pusher movable through said opening in said compartment to push an article radially outwardly from the turntable when its associated compartment is aligned with the discharge opening in said housing.

3. An apparatus in accordance with claim 2 in which said ejector means includes a fluid operated cylinder having a pusher rod movable from a retracted position in which it is disposed radially inwardly of the turntable compartments and an extended position in which the pusher extends radially across the compartment aligned with a discharge station.

4. An apparatus in accordance with claim 3 including means for mounting the cylinder from the roof for the housing, and a lower support bearing means for engagement with the rotating turntable.

5. An apparatus in accordance with claim 4, including a guide rod means associated with said fluid cylinder and said pusher rod for parallel movement therewith to resist turning of the pusher rod during an ejection of an article from a compartment.

6. An apparatus in accordance with claim 5 including a switch actuator means movable with said pusher rod to enable and disable the turntable drive means during a ejection operation.

7. An apparatus for curing ink on the exterior of articles by irradiating the same with UV light at a curing station and for automatically ejecting the cured articles at a discharge station, said apparatus comprising a housing having a loading station and a discharge station, a UV light source for irradiating the articles at the curing station, a turntable rotatably mounted about a vertical axis and having a plurality of compartments thereon to shield against UV light emission from the curing station, said compartments including radially extending walls for an inner wall having an opening therein, each compartment receiving and supporting an article to be cured at the curing station and then moved to the discharge station, a housing having top wall and sidewall partially surrounding the turntable and enclosing the curing station to prevent the emission of UV light, an ejector means mounted radially inwardly of the turntable and including a pusher rod aligned for travel into and from the opening in each compartment inner wall as each compartment is brought into in the discharge station for pushing an article from the turntable, said ejector means being suspended from said roof and being held stationary against rotation with the turntable and being located radially inwardly of the inner walls of said compartments, and conveying means for automatically conveying an article ejected by the ejector means from the curing apparatus.

8. An apparatus in accordance with claim 7 in which an indexing drive means is provided to index the turntable through intermittent steps, and switch means operable by the pusher rod to disable the indexing drive means from turning the turntable when the ejector means is extended.

* * * * *

UNITED STATES PATENT AND TRADEMARK OFFICE

CERTIFICATE OF CORRECTION

PATENT NO. : 4,578,880

DATED : April 1, 1986

INVENTOR(S) : Phil Motev, Melvin E. Green

It is certified that error appears in the above-identified patent and that said Letters Patent is hereby corrected as shown below:

Column 3, line 47 change "interfer" to --interfere--.
Column 4, line 16 change "42" to --41--.
Column 4, line 34 change "rectinlinear" to --rectilinear--.
Column 4, line 39 change "shaft" to --shafts--.
Column 7, line 15 change "Il" to --IL--.
Column 9, line 15 change "22" to --32--.

Column 11, line 3 after "claim 4" delete --,-- (comma).
Column 11, line 10 change "a" to --an--.
Column 11, line 24 change "for" to --and--.
Column 12, line 10 delete "in".

Signed and Sealed this

*First* Day of *July 1986*

[SEAL]

*Attest:*

DONALD J. QUIGG

*Attesting Officer*

*Commissioner of Patents and Trademarks*